United States Patent [19]

Twyman et al.

[11] 4,234,283

[45] Nov. 18, 1980

[54] SCRAP METAL FED SYSTEM FOR A CLOSED ROTARY KILN OR HEATING OVEN

[75] Inventors: Noel H. Twyman, Newport Beach; Robert F. Jenkins, Laguna Niguel, both of Calif.

[73] Assignee: Automated Production Systems Corporation, Tustin, Calif.

[21] Appl. No.: 897,381

[22] Filed: Apr. 18, 1978

Related U.S. Application Data

[63] Continuation-in-part of Ser. No. 771,967, Feb. 25, 1977, abandoned.

[51] Int. Cl.[3] ..... B66C 17/08

[52] U.S. Cl. ..... 414/171; 414/200; 222/450; 198/532; 198/557

[58] Field of Search ..... 222/450, 476, 504; 414/150, 152, 157, 172, 196, 199, 200, 221, 171; 198/532, 547, 557, 616, 688, 698, 822; 266/87

[56] References Cited

U.S. PATENT DOCUMENTS

| | | | |
|---|---|---|---|
| 1,629,968 | 5/1927 | Richards | 414/200 |
| 2,626,066 | 1/1953 | Rasmussen | 222/450 |
| 2,721,005 | 10/1955 | Lesnick | 222/450 |
| 3,365,049 | 1/1968 | Raab | 198/688 |
| 3,410,422 | 11/1968 | Carpentier | 414/221 |
| 3,592,556 | 7/1971 | Campbell | 198/616 |

FOREIGN PATENT DOCUMENTS

| | | | |
|---|---|---|---|
| 964127 | 5/1957 | Fed. Rep. of Germany | 198/822 |

*Primary Examiner*—Joseph E. Valenza
*Attorney, Agent, or Firm*—Edward D. O'Brian; K. H. Boswell

[57] ABSTRACT

A scrap metal feed system is described employing an endless conveyor having a surface for supporting materials thereon. The conveyor is equipped with lifters extending outwardly from the surface at periodic intervals. A first hopper feeds this conveyor and a second hopper at the inlet end of a rotary kiln receives the scrap from the conveyor. The conveyor extends horizontally beneath the bottom of the first hopper and then upwardly at an angle to the horizon less than eighty degrees and greater than fifty degrees and then terminates over the top of the second hopper. The conveyor is exposed to the interior of the first hopper as it extends upwardly at an angle to the horizontal so that material can move back along the conveyor to the first hopper as the conveyor is operated; as the material moves back to the first hopper a shearing action results which tends to break up large pieces of material and/or separate pieces of material which are adhering to each other. The material that remains on the conveyor is conveyed up the conveyor and is deposited in the second hopper. The second hopper is attached to a chute having two flapper gate valves within the interior of the chute which are coupled together such that when one flapper gate is in an open position the other is not. The coupling is achieved by rotating striker arm which sequentially abuts against a lever attached to the flapper gate valves and causes the valves to open.

4 Claims, 6 Drawing Figures

SCRAP METAL FED SYSTEM FOR A CLOSED ROTARY KILN OR HEATING OVEN

CROSS-REFERENCE TO RELATED APPLICATIONS

This application is a continuation-in-part of our prior application Ser. No. 771,967, filed Feb. 25, 1977, entitled "USE OF CONVEYOR HAVING LIFT FLIGHTS TO SEGREGATE AND BREAK UP MATERIAL WHILE REMOVING THE MATERIAL FROM A HOPPER" now abandoned, the disclosure of which is herein incorporated by reference.

BACKGROUND OF THE INVENTION

The invention set forth in this specification pertains to a feed system for introducing metallic scrap into a rotary kiln or other type of heating oven. The invention is primarily intended to be used and is considered to have its primary utility in connection with conveying aluminum scrap into a rotary kiln used to clean the scrap prior to reclaiming the aluminum.

Since rotary kilns used to clean or dry aluminum scrap are generally of a large radius and are also inclined such that the inlet end is of higher elevation than the outlet end, it is necessary to raise the scrap in order to introduce it into the kiln. Additionally it is desirable to isolate the kiln from the ambient atmosphere to prevent escape of vapors from the kiln to the ambient atmosphere and to inhibit the introduction of cool ambient air into the kiln. Generally material is raised to the inlet opening of the kiln with a conveyor. A wide variety of different conveyors can be utilized for this purpose and among such conveyors are "endless conveyors" constructed so as to have a surface for supporting the material and lift flights extending outwardly from this surface at periodic intervals along the length of the surface. Conveyors of this type can be endless belt conveyors utilizing a continuous or endless belt to provide such a surface and having lifters or flights attached to the belt so as to extend from it.

More commonly such conveyors are what are referred to as "apron" conveyors. Such conveyors are generally constructed so as to utilize an endless chain type mechanism to support and carry overlapping or closely adjacent plates or pans used to provide a supporting surface as indicated in the preceding. It is common to attach lifts or flights to such aprons or pans. It will be realized that both of these types of conveyors can be utilized as conveyors without such lifters or flights. However, the use of such lifters or flights is considered to be necessary in order to prevent material from sliding back on such conveyors when such conveyors are oriented so as to extend at an angle to the horizontal.

The amount which such a conveyor is inclined so as to extend at an angle to the horizontal is normally limited so as to avoid a conveyor going upwardly at an angle sufficiently great so that the material will slide back along the length of the conveyor. Thus, for example, the Chemical Engineer's Handbook by Perry, Third Edition, McGraw-Hill Book Company, Inc., 1950, contains the following statement relative to flight conveyors (page 1347):

"The conveyor may be inclined up to a point where the load begins to flow backward over the tops of the flights. The limit is about thirty degrees. The capacity becomes smaller as the slope increases."

Although this statement is in respect to the use of flights as essentially pushers to push along a material as such material is conveyed, it is considered applicable to conveyors as noted in the preceding having a supporting surface and having flights extending outwardly from this surface.

In the use of known conveyors for the purpose of elevating metal scrap such as aluminum scrap certain problems have been noted which are considered to be reasonably unique to the movement of such scrap. In general, such scrap tends to consist of metal particles such as lathe turnings, chunks of sheet metal of various sizes and shapes and the like, of an extremely non-uniform character contaminated with various different organic and inorganic materials. These contaminants can effect the manner in which such particles tend to adhere to one another and/or separate from one another.

Because noxious and irritating vapors are produced in drying and cleaning kilns it is necessary when said vapors are present to seal such a kiln from the immediate environment. Additionally since these kiln or heating ovens generally utilize hot gases to dry and clean the scrap metal, the introduction of cool ambient air into the kiln or heating oven during introduction of scrap into the oven lowers the temperature of the gases in the oven and therefore effects the operation of the kiln or heating oven. Typically a conventional screw-type feed system has been used to charge kilns; however, since the aluminum scrap metal particles are of a non-uniform character as described above, they cannot be conveniently fed into rotary kilns through a conventional screw-type feed system which requires rather uniformly and relatively small sized particles in order to work efficiently.

The present invention is based upon a recognition that conventional "endless" conveyors have not been particularly effective in moving scrap from a pile of scrap and/or a hopper at a controllable rate and further, since said scrap is of a non-uniform size conventional screw-type feed systems are also disadvantageous. Further the present invention is based upon a recognition that such conventional conveyors tend to take up an inordinate amount of floor space when operated in a conventional manner because of the relatively small angle to the horizontal at which they can be located, and when this is coupled with a screw-type feed system projecting horizontally from the kiln inlet an additional amount of floor space is required.

SUMMARY OF THE INVENTION

A broad object of the present invention is to provide a new and improved manner of charging a rotary kiln or heating oven with scrap metal. As such, the invention pertains to both a conveyor system for lifting the material to the inlet end of a kiln or oven and to an airlock system for isolating the interior of the kiln or oven from the ambient environment as the material is added to the kiln or oven. The invention includes the discovery that when a conveyor is utilized as described in connection with a feed hopper, that the conveyor serves as an important means for breaking up and segregating material being moved by the conveyor so that at any one speed of a variable set of speeds, the conveyor tends to deliver a substantially uniform quantity of material at a substantially uniform rate to the inlet opening of the kiln or oven.

In accordance with this invention a scrap metal feed system is disclosed employing an endless conveyor having a surface for supporting materials and having lifters extending outwardly from the surface at periodic intervals and employing a first hopper for feeding the conveyor and a second hopper for receiving scrap at the inlet end of the kiln or oven, the conveyor extending horizontally beneath the bottom of the first hopper and then upwardly at an angle to the horizontal less than 80° and greater than 50° and terminating over the top of the second hopper and the conveyor is exposed to the interior of the first hopper and the conveyor is exposed to the interior of the first hopper as it extends upwardly at an angle to the horizontal so that material can move back along the conveyor to the first hopper as the conveyor is operated and so that the material conveyed by the conveyor is deposited in the second hopper which is in turn attached to a chute having two flapper gate valves in the interior of the chute and the flapper gate valves are coupled such that when one flapper gate valve is in an open position the other flapper gate valve is closed.

It is believed that it will be apparent from the preceding that the process of the invention involves utilizing a conveyor having a surface for supporting material and lift flights spaced equally from one another so as to extend outwardly from this surface to segregate and break up material while elevating the material from a hopper which comprises: shearing off material from the bottom of the hopper as the conveyor advances so that there is material located uniformly between the flights and the conveyor, moving the conveyor upwardly at an angle sufficiently great so that the material between the lifters of the conveyor will tend to slide back off the conveyor except adjacent to the uppermost surfaces of the flights and so that such sliding material will tend to move along the conveyor back into the hopper, and imparting motion to the material moving back along the conveyor by contact between such material and the conveyor and material held by the conveyor so as to partially break up the material moving back to the hopper.

After being conveyed up the conveyor, the material so conveyed is deposited in the second hopper and descends under the influence of gravity to the first flapper gate valve and is retained there until this valve opens. The first and second flapper gate valves are coordinated such that when one is open the other is not. As such after passing through the first flapper gate valve the material is retained by the second flapper gate valve. The first flapper gate valve is then closed and after the chute is sealed off by the first flapper gate valve the second flapper gate valve opens and the material is passed along the chute to the inlet opening of the kiln or oven.

BRIEF DESCRIPTION OF THE DRAWINGS

The invention is best more fully explained with reference to the accompanying drawings in which.

Figure 1:
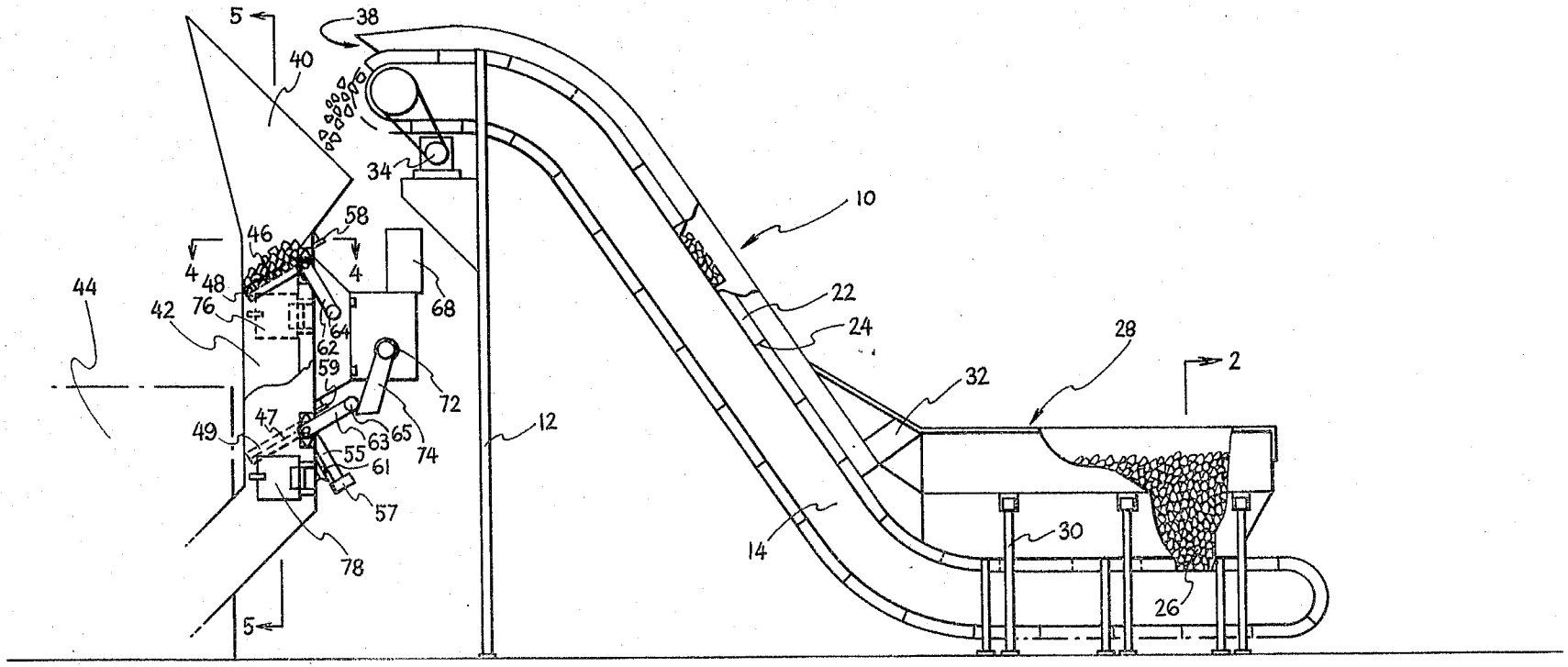
FIG. 1 is a side elevational view of a presently preferred embodiment of an apparatus in accordance with this invention, this view being partially broken away to more clearly illustrate the manner in which the invention operates.
Figure 2:
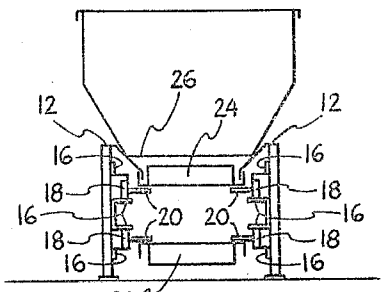
FIG. 2 is a cross-sectional view taken at line 2—2 of FIG. 1.
Figure 3:
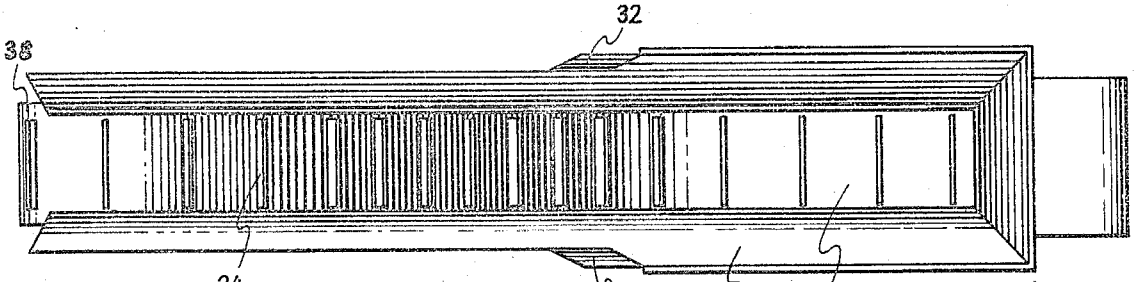
FIG. 3 is a top plan view of the apparatus indicated in FIG. 1.

The invention described in this specification utilizes such operative concepts or principles as are set forth and defined in the appended claims forming a part of this specification. Those skilled in the art to which the invention pertains will realize that these concepts or principles can be easily applied in a number of different ways. For this reason the invention is not to be considered as being limited to the precise apparatus illustrated in the drawing.

DETAILED DESCRIPTION

The conveyor section 10 of the apparatus includes an appropriate conventional framework 12 for supporting an endless conveyor 14. This framework 12 includes rails 16 which are utilized to support rollers 18 located at equal intervals along the length of the conveyor 14. Appropriate conventional bearing and shaft mechanisms 20 associated with each of the rollers 18 are employed to support what may be loosely referred to as "conveyor sections" (not separately numbered) each of which includes an overlapping pan or plate 22 carrying an upstanding plate-like flight or lifter 24 extending across its width. These plates 22 overlap slightly in accordance with conventional practice. The lifters 24 are of uniform dimension and are uniformly spaced from one another.

The framework 12 carries the conveyor 14 so that it extends horizontally beneath a bottom opening 26 in hopper 28. Preferably hopper 28 is supported by a separate framework 30 so as to avoid any possibility of the weight of material within the hopper 28 causing deformation which would affect the operation of the conveyor 14. The conveyor 14 extends upwardly from the bottom opening 26 of the hopper 28 at an angle to the horizontal as hereinafter indicated past sloping transition sections or walls 32 on the hopper 28 which are located so that material can "flow" off the conveyor 14 as it extends upwardly and back into the interior of the hopper 28.

The conveyor is driven by conventional means such as motor, belt and pulley assembly 34 which also includes other conventional controls allowing for the speed of the conveyor to be adjusted. Material such as aluminum scrap is placed within the hopper 28. The action of gravity will normally cause such scrap to fall downwardly through the opening 26 so as to cover substantially the entire surfaces (not separately numbered) of the plates 22 exposed to the hopper 28. This will of course fill in the areas on the conveyor 14 between the lifters 24. As the conveyor 14 is advanced in a conventional manner (using conventional equipment for this purpose which is not shown) these lifters 24 will tend to exercise a shearing action so as to shear off the scrap caught between them from the remainder of the scrap located above them in the hopper 28. As the conveyor 14 is advanced more material will move downwardly against the conveyor 14 to fill in space as space becomes available.

As the conveyor 14 is further advanced from where it moves horizontally beneath the hopper 28 it progresses upwardly at a sufficiently steep angle so that material caught between the lifters 24 will tend to slide backward along the conveyor 14 due to the action of gravity. Small areas of material of roughly a triangular cross-sectional configuration will be held against the upper surfaces (not separately numbered) of the lifters 24 and will be conveyed all the way to the top of the framework 12 as the conveyor 14 operates. By regulating the speed of the conveyor 14 it is possible to elevate substantially uniform quantities of metal at a uniform rate in this manner.

With the invention the material which slides back along the conveyor 14 as the conveyor 14 is operated tends to bind together and roll back into the hopper 28. As this occurs this material will be contacted by the upwardly moving conveyor 14 itself. As a result of this action the operation of the conveyor 14 will tend to segregate out comparatively large pieces of metal moved upwardly from the hopper 28 and further the pieces of metal which tend to fall or cascade back toward the hopper 28 will tend to abrade against themselves and against the conveyor 14 so as to be partially broken up by the action achieved. In addition, of course, there is some breakup of the metal particles as a result of the shearing action achieved as the conveyor 14 moves through the bottom opening 26 to the hopper 28.

It will, of course, be recognized that the greater the angle at which the conveyor 14 is turned upwardly to the horizontal the greater the quantity of material which will tend to move back into the interior of the hopper 28 and the less the quantity of material held by the lifters 24 so as to be delivered at the top of the framework 12. It is possible to alter the angle at which the conveyor 14 extends upwardly to the horizontal so that this angle is sufficiently small so that no material or substantially no material will tend to move back along the conveyor 14 into the hopper 28.

The present invention is concerned with utilizing the conveyor section 10 so as to obtain an incidental breaking up and grinding and segregating type action as a result of the operation of the conveyor 14. At present it is considered that the most effective results of this type (effective delivery of uniform quantities of material along with noticeable material breakup) can be achieved when the conveyor 14 extends upwardly from a horizontal path at an angle of about sixty-five degrees (65°). It is also considered, however, that practically usable results can be achieved when this angle is from about fifty degrees (50°) to about eighty degrees (80°). It is to be emphasized that these angles do not represent any sharp transition in the nature of the results achieved with the invention.

Figure 4:
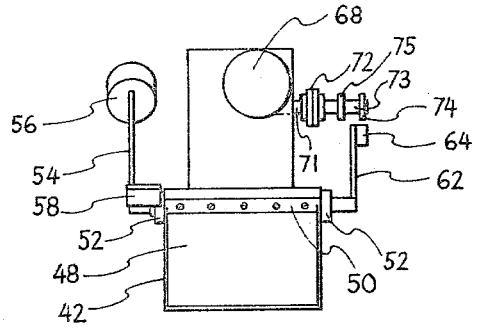
FIG. 4 is a cross-sectional view taken at line 4—4 of FIG. 1.
Figure 5:
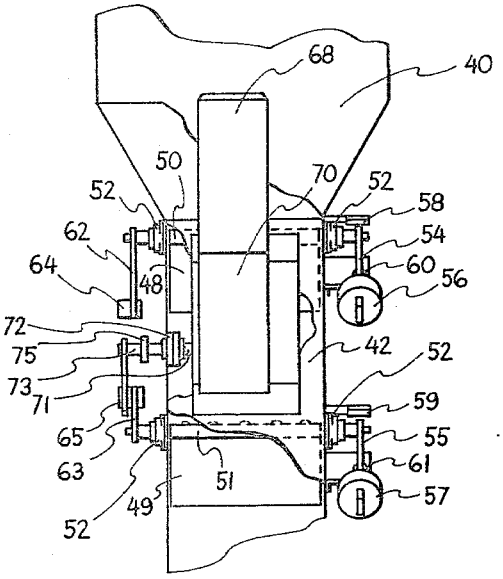
FIG. 5 is an elevational view taken at line 5—5 of FIG. 1.

The scrap material which is retained on the conveyor 12 is lifted up and is discharged from the conveyor 14 at the upper end 38 of the conveyor and from there falls into hopper 40. Hopper 40 is integrally connected to the upper end of chute 42. Chute 42 extends downward and culminates at the inlet end of rotary kiln 44 shown in phantom. Interspaced between hopper 40 and rotary kiln 44 are two identical flapper gate valves 46 and 47 which as shown in FIG. 4 consist of plates 48 and 49 having a shape which matches the shape of the chute 42 such that the plates 48 and 49 fit within the interior of the chute 42 and form barriers therein. Plates 48 and 49 are attached along one edge to shafts 50 and 51. Shafts 50 and 51 are rotatively mounted within pivots on both sides of chute 42, these pivots commonly referred to by numeral 52.

Attached to one end of shafts 50 and 51 are counterweight arms 54 and 55 having counterweights 56 and 57 on the end thereof. The amount of travel of counterweight arms 54 and 55 is defined by cushions 58 and 59 and shock absorbers 60 and 61. When counterweight arms 54 and 55 rest against shock absorbers 60 and 61 plates 48 and 49 of the flapper gate valves 46 and 47 mate against the inside edges of chute 42 forming a seal. When plates 48 and 49 pivot about shafts 50 and 51 down into chute 42 counterweight arms 54 and 55 are raised until they abut with cushions 58 and 59 which further inhibit their travel. Counterweight arms 54 and 55 are so positioned on shafts 50 and 51 that when counterweight arms 54 and 55 abut against cushions 58 and 59 the flapper gate valves swing down within chute 42 and allow scrap metal to pass past the valves and further down the chute.

On the opposite end of shafts 50 and 51 are mounted lever arms 62 and 63. Rollers 64 and 65 are attached to the end of lever arms 66 and 67. A motor 68 fits on and drives a reducer 70 which in turn is coupled via shaft 71 to a torsion coupling 72 attached to shaft 73 which in turn is attached to a striker arm 74. Shaft 73 turns in bearing 75 and striker arm 74 rotates in an arch such that the striker arm abuts against rollers 64 and 65 attached to lever arms 62 and 63.

When viewed from the side as per FIG. 1 lever arm 62 on the upper flapper gate valve 46 is positioned approximately perpendicular to plate 48. Lever arm 63 of the lower flapper gate valve 47 lies in a plane perpendicular to plate 49. Because of this special relationship striker arm 74 first causes the lower flapper gate valve 47 to open as the striker arm is rotated in a clockwise direction. When the lower gate valve is in its extreme open position roller 65 rolls off of the end of striker arm 74 and the lower gate valve is returned to a closed position by the gravitational force acting upon counterweight 57. Striker arm 74 then continues in its clockwise path and engages roller 64 of upper flapper gate valve 46. As the striker arm continues rotating lever arm 62 is displaced by the motion of striker arm 74 causing the upper flapper gate valve to open until the roller 64 on lever arm 62 of the upper flapper gate valve 46 reaches the end of the striker arm 74 and is finally displaced off of the end of striker arm 74. The upper flapper gate valve 46 is then returned to a closed position by the counterweight as previously described.

When the scrap material is deposited into hopper 40 it falls down chute 42 until it rests upon the upper surface of plate 48. When the upper flapper gate valve 46 is opened by the striker arm the material on plate 48 slides down and comes to rest upon the upper surface of plate 49 of the lower flapper gate valve 47. After the upper flapper gate valve closes it starts accumulating a new charge of scrap material. However, striker arm 74 continues rotating and engages lever arm 62 of the lower flapper gate valve 47. This opens the lower flapper gate valve 47 and the initial charge of material resting upon this flapper gate valve is allowed to descend down the chute 42 into the rotary kiln 44. Because the upper flapper gate valve was in a closed position at this time any noxious vapors from the interior of the kiln 44 were prevented from exiting chute 42 by the upper flapper gate valve 46 and additionally the kiln was sealed to atmospheric air entering the kiln.

Included along the length of chute 42 are two clean-out doors 76 and 78. One door is placed slightly below the upper flapper gate valve and the other door is placed slightly below the lower flapper gate valve. These doors allow for access to the interior of the chute 42 for routine maintenance and also render it possible to easily free any material which might become wedged between plates 48 or 49 and chute 42.

Shock absorbers 60 and 61 are so placed that the upward movement (closing movement) of the flapper gate valves is stopped before the plates 48 and 49 strike the sides of chute 42 damaging the same. The torsion coupling 72 is provided to absorb the shock energy resulting from striker arm 74 hitting rollers 64 and 65. A torsion bar can be substituted for this torsion coupling to achieve the same purpose.

The plates 48 and 49 of the upper and lower flapper gate valves are oriented parallel to each other so that a maximum distance is achieved for handling large pieces of scrap. The orientation angles of the flapper gate valves from the horizontal and also the orientation of the flapper gate valves with respect to lever arms 62 and 63 and the location of striker arm 74 are established so that the striker arm 74 will alternately open and close the flapper gate valves. If either one of the flapper gate valves is open, the other one will be closed. This relationship effectively seals off the inlet opening of the rotary kiln 44 from both ingress and egress of gases.

The mass of the flapper gate valves and the connected counterweight assembly is selected such that the mass of these components is sufficient such that the flapper gate valves will not be opened by the inertia imparted by the mass of the scrap metal hitting on the flapper gate valves.

Figure 6:
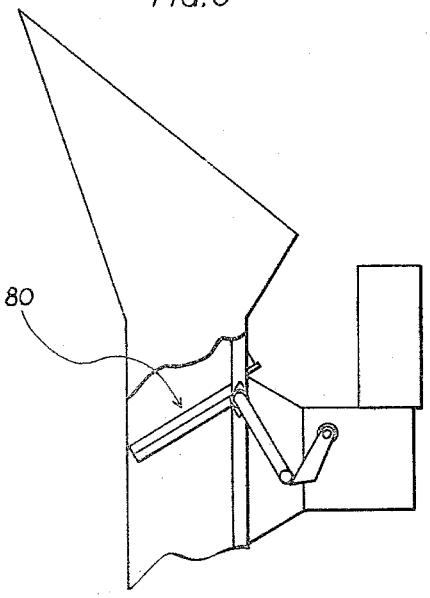
FIG. 6 is an elevational view in partial section of a portion of a modified embodiment of the invention.

In a modified embodiment of the invention shown in FIG. 6 only one flapper gate valve 80 is placed within the chute 42 and the rotary kiln 44 is provided with a means (not shown in the drawing) for maintaining a negative gas pressure within the interior of the kiln. This negative gas pressure could be created by a draft fan connected to the kiln such as is described in the co-pending application of one of us, Ser. No. 771,846, filed Feb. 25, 1977, entitled "METHOD AND APPARATUS FOR TREATING METALLIC SCRAP IN THE RECOVERY OF METAL THEREFROM". The disclosure is herein incorporated by reference.

The single flapper gate 80 is actuated by a striker arm 74 identical with that as previously described. This cycles the single flapper gate 80 so that it is in an open position approximately 25% of the time and is closed approximately 75% of the time. When this single flapper gate valve is in an open position the negative air pressure within the kiln prevents the escape of noxious or irritating vapors to the ambient atmosphere. The single flapper gate valve 80 is identical to the flapper gate valve previously described and also includes a shock absorber and cushion as previously described.

We claim:

1. A scrap metal feed system which comprises:

an endless variable speed conveying means, said conveying means including a surface for supporting materials, said surface having flights extending outwardly from said surface at periodic intervals along the length of said surface, a first hopper means, a second hopper means, said conveying means extending horizontally beneath the bottom of said first hopper means and then upwardly at an angle to the horizontal greater than about 50 degrees and less than about 80 degrees and terminating over the top of said second hopper means, said conveyor being exposed to the interior of said first hopper as it extends upwardly to said angle to the horizontal so that material can move back along said conveyor means into said first hopper as said conveyor is operated, said conveyor being positioned near the top opening of said second hopper means so that the material conveyed by said conveying means is deposited into said second hopper means, chute means, said chute means having an upper end and a lower end, said upper end integrally connected with the bottom of said second hopper means, the lower end opening into a kiln, said chute means having two flapper gate means interposed between said upper end and said lower end, said flapper gate means having an open and a closed position, coordinated activating means opening and closing said flapper gate means such that when one of said flapper gates is in an open position, the other is not, each of said flapper gate valves including a shaft pivotally mounted in said chute and a plate attached to said shaft along one side of said plate such that said plate opens and closes in said chute as said shaft pivots, and a counterweight means attached to one end of said shaft for reversibly maintaining said flapper gate in a closed position, said coordinating activating means including a lever arm attached to the other end of said shaft and abutting means which sequentially abuts against said lever arm opening said flapper gate valves, motor means activating said abutting means, said lever arm includes a roller on the end thereof, said abutting means includes a striking arm, said motor means connected to said striking arm such that said striking arm engages said roller on said lever arm displacing said lever arm as said striking arm rotates.

2. A scrap metal feed system as claimed in claim 1 including:

a torsion coupling interposed between said motor means and said striking arm.

3. A scrap metal feed system which comprises:

an endless variable conveying means, said conveying means including a surface for supporting materials, said surface having flights extending outwardly from said surface at periodic intervals along the length of said surface, a first hopper means, a second hopper means, said conveying means extending horizontally beneath the bottom of said first hopper means and then upwardly at an angle to the horizontal greater than about 50 degrees and less than about 80 degrees and terminating over the top of said second hopper means, said conveyor being exposed to the interior of said first hopper as it extends upwardly to said angle to the horizontal so that material can move back along said conveyor means into said first hopper as said conveyor is operated, said conveyor being positioned near the top of said second hopper means so that the material conveyed by said conveying means is deposited into said second hopper means, chute means, said chute means having an upper and a lower end, said upper end integrally connected with the bottom of said second hopper means, the lower end opening into a kiln, said chute means having a flapper gate valve means between said upper end and said lower end, said flapper gate valve means having an open and a closed position, said kiln having gas pressure regulating means such that the gas pressure in said kiln is maintained at a negative value in respect to the ambient atmosphere, flapper gate valve means having activating means for moving said flapper gate valve means from said closed position to said open position, flapper gate valve means having closing means for moving said flapper gate valve from said open position to said closed position, said flapper gate valve means comprises a flapper gate valve, said flapper gate valve including a shaft pivotally mounted in said chute and a plate attached to said shaft along one side of said plate such that said plate opens and closes in said chute as said shaft pivots, said closing means comprises a counterweight means attached to said shaft for reversibly maintaining said flapper gate in a closed position, said activating means comprises a lever arm attached to the other end of said shaft, said lever arm including a roller on the end thereof, a striker arm, motor means connected to said striker arm such that said striker arm engaging said roller on said lever arm displaces said lever arm and opens said flapper gate valve.

4. A scrap metal feed system which comprises:

an endless variable speed conveying means, said conveying means including a surface for supporting materials, said surface having flights extending outwardly from said surface at periodic intervals along the length of said surface, a first hopper means, a second hopper means, said conveying means extending horizontally beneath the bottom of said first hopper means and then upwardly at an angle to the horizontal greater than about 50 degrees and less than about 80 degrees and terminating over the top of said second hopper means, said conveyor being exposed to the interior of said first hopper as it extends upwardly to said angle to the horizontal so that material can move back along said conveyor means into said first hopper as said conveyor is operated, said conveyor being positioned near the top opening of said second hopper means so that the material conveyed by said conveying means is deposited into said second hopper means, chute means, said chute means having an upper end and a lower end, said upper end integrally connected with the bottom of said second hopper means, the lower end opening into a kiln, said chute means having two flapper gate means interposed between said upper end and said lower end, said flapper gate means having an open and a closed position, coordinated activating means opening and closing said flapper gate means such that when one of said flapper gates is in an open position, the other is not, each of said flapper gate means comprising a flapper gate valve, each of said flapper gate valves including a shaft pivotally mounted in said chute and a plate attached to said shaft along one side of said plate such that said plate opens and closes in said chute as said shaft pivots, and a counterweight means attached to said shaft for reversibly maintaining said flapper gate in a closed position, said coordinating activating means including a lever arm attached to said shaft and abutting means which sequentially abuts against said lever arm opening said flapper gate valves, motor means activating said abutting means, each of said lever arm including a roller on the end thereof, said abutting means includes a rotating means, said motor means connected to said rotating means so that said rotating means engages said rollers on said lever arms displacing said lever arms as said striking arm rotates.

* * * * *

UNITED STATES PATENT AND TRADEMARK OFFICE

CERTIFICATE OF CORRECTION

PATENT NO. : 4,234,283

DATED : November 18, 1980

INVENTOR(S) : Noel H. Twyman and Robert F. Jenkins

It is certified that error appears in the above-identified patent and that said Letters Patent are hereby corrected as shown below:

The title of the patent should read "SCRAP METAL FEED SYSTEM..." instead of "SCRAP METAL FED SYSTEM..."

Column 8, (Claim 1), line 28, before the clause beginning "each of said flapper gate valves...", read the following clause: --each of said flapper gate means comprising a flapper gate valve,--.

Signed and Sealed this

*Eighth* Day of *September 1981*

[SEAL]

*Attest:*

GERALD J. MOSSINGHOFF

*Attesting Officer* *Commissioner of Patents and Trademarks*